US006943751B2

(12) United States Patent
Puett, III et al.

(10) Patent No.: US 6,943,751 B2
(45) Date of Patent: Sep. 13, 2005

(54) CLIP FOR MOUNTING A NOVELTY ITEM

(76) Inventors: Ralph Thomas Puett, III, 2975 McDonald La., Corona, CA (US) 92881; Ralph Thomas Puett, IV, 2975 McDonald La., Corona, CA (US) 92881

( * ) Notice: Subject to any disclaimer, the term of this patent is extended or adjusted under 35 U.S.C. 154(b) by 0 days.

(21) Appl. No.: 10/255,816

(22) Filed: Sep. 26, 2002

(65) Prior Publication Data

US 2004/0066343 A1 Apr. 8, 2004

(51) Int. Cl.[7] ..... H01Q 1/00; A47G 33/08
(52) U.S. Cl. ..... 343/878; 428/11; 343/720
(58) Field of Search ..... 343/878, 711, 343/713, 715, 720; 116/28 R, 209

(56) References Cited

U.S. PATENT DOCUMENTS

| | | | | | |
|---|---|---|---|---|---|
| D60,773 | S | | 4/1922 | Carter | D11/168 |
| 4,262,409 | A | * | 4/1981 | Madej | 29/526 R |
| D264,571 | S | | 5/1982 | Orastek | D11/166 |
| 4,787,161 | A | | 11/1988 | Feng | 40/334 |
| 4,978,964 | A | * | 12/1990 | Castille | 343/718 |
| 4,984,379 | A | | 1/1991 | Lee | |
| 5,572,225 | A | * | 11/1996 | McCarthy | 343/720 |
| D407,346 | S | | 3/1999 | Wyatt et al. | D11/168 |
| 5,904,116 | A | | 5/1999 | Wyner et al. | |
| 6,085,459 | A | * | 7/2000 | Conner | 47/41.01 |
| 6,247,423 | B1 | * | 6/2001 | Ingram et al. | 116/28 R |
| 6,371,043 | B1 | | 4/2002 | Pearison | |
| D488,090 | S | | 4/2004 | Hester | D11/168 |
| 2003/0192467 | A1 | | 10/2003 | Paris | 116/173 |
| 2003/0200683 | A1 | | 10/2003 | Gallen | 116/173 |

* cited by examiner

*Primary Examiner*—James Vannucci

(57) ABSTRACT

A conical mount is used to mount a novelty item such as a pennant, figurine, or advertising shape secure on a post such as an automobile antenna. The conical mount secures the item rigidly to the antenna at any selected location by cooperating with a corresponding conical aperture on the mounted item to provide a fitted attachment between the novelty item and the conical mount. The two halves of the conical mount have mating tabs and slots that provide for a compressive interlock about the varying diameters of an antenna.

7 Claims, 2 Drawing Sheets

CLIP FOR MOUNTING A NOVELTY ITEM

FIELD OF THE INVENTION

The present invention relates generally to novelty items, and more particularly to a clip used to mount a novelty item such as a pennant, figurine, or advertising shape on to a post such as an automobile antenna or a writing utensil.

BACKGROUND OF THE INVENTION

It has become very popular to display various items on one's automobile antenna theses days. Further, the proliferation of items that one can mount on an automobile antenna grows every day. Numerous items can be mounted on an antenna from pennants that show support for one's favorite team, to souvenirs that reflect a visit to a favorite vacation destination, to gas station and fast food figures and shapes. However, it is often difficult to mount the item on the antenna in a manner that will reduce the risk that the item will become dislodged or disconnected during driving conditions. When driving at a high rate of speed, the item is subjected to large dynamic forces caused by movement of air over the vehicle. If not securely attached, the item will become separated from the antenna. It has been customary to locate the item at the very top of the antenna using attachments that were too complicated and expensive, or that were unable to hold the display item to the antenna under all conditions.

SUMMARY OF THE INVENTION

The present invention relates to a clip used to mount a novelty item such as a pennant, figurine, or advertising shape on to a post such as an automobile antenna or a writing utensil. A preferred embodiment of the present invention provides a conical mount that cooperates with a corresponding conical aperture on the mounted item to provide a fitted attachment The conical mount is in two halves adapted to be mounted together around an antenna, and to hold fast to the antenna anywhere along its length.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a clip for mounting a novelty item.

Figure 1:
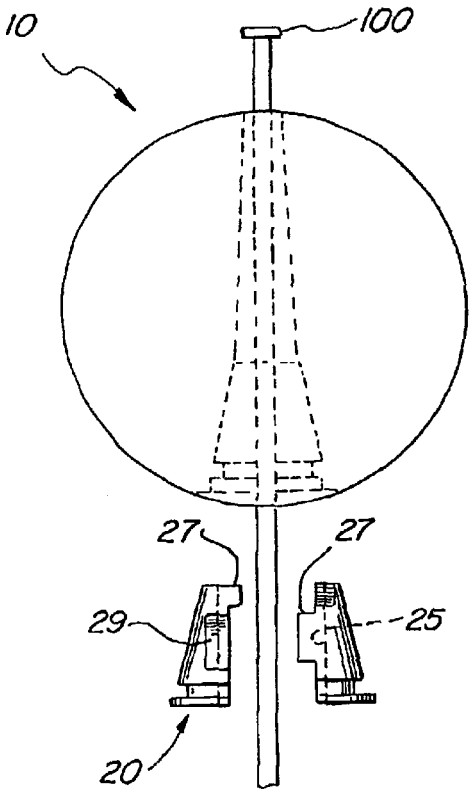
FIG. 1 is a partial exploded front view of a preferred embodiment of the invention mounted on an antenna.
Figure 2B:
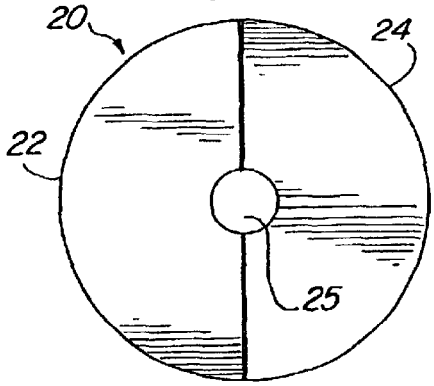
FIG. 2*b* is a bottom view of a preferred embodiment of the conical mount.
Figure 2C:
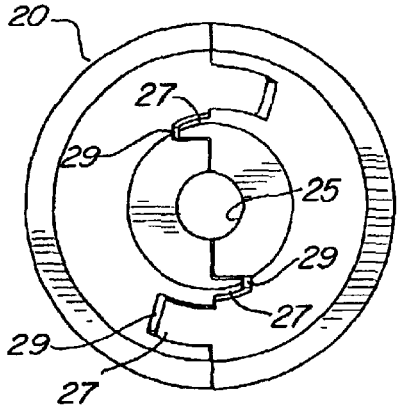
FIG. 2*c* is a top view of a preferred embodiment of the conical mount.
Figure 2A:
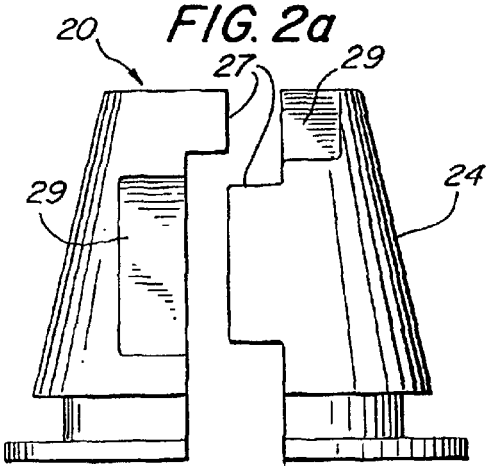
FIG. 2*a* is a side exploded view of a preferred embodiment of the conical mount.
Figure 2D:
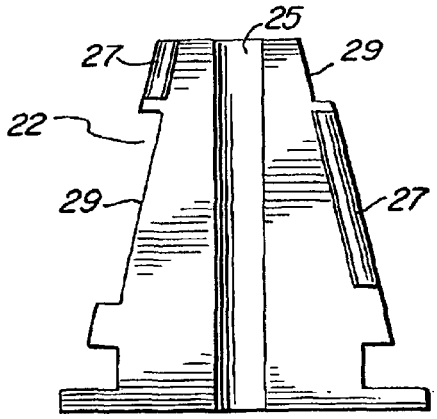
FIG. 2*d* is a side view of a preferred embodiment of one half of the conical mount.

FIG. 1 illustrates a preferred embodiment of the present invention 10. A conical mount 20 has two halves 22, 24 which when snapped in place on an antenna 100 supports a novelty item 30 (FIG. 3) such as a racing tire, a pennant, or a football helmet, for example. The conical mount 20 is preferably in the shape of a wedge. In general, the conical mount 20 is insertable into a tapered aperture 35 (FIGS. 3, 5) of the novelty item 30 to support the item 30 on the antenna 100 wherever it is placed.

A channel 25 through the middle of the conical mount 20 accommodates an antenna 100. It is formed by a semi-circular groove longitudinally disposed in each half 22, 24 of the conical mount. When the conical mount 20 is closed on an antenna 100, the two semi-circular grooves are juxtaposed to form an annular channel 25 sized to receive the antenna 100 about its circumference with a compressive force. The channel 25 is open at both ends of the mount 20 to allow the mount 20 to be located anywhere along the antenna length. The compressive force is sufficient to clamp the mount 20 to the antenna 100 to reliably secure the mount 20 on the antenna at its relatively thin location and lower down where the antenna has a thicker diameter.

Referring now to FIGS. 2*a*–2*d*, for a detailed view of the conical mount, two resilient tabs 27 depend from opposite edges of each half 22, 24 of the mount. When brought in initial contact with each other, there is a slight interference as the tabs 27 contact a corresponding portion of the complimentary edge of the other half. As the halves 22, 24 are pushed toward each other the interference is overcome and the tabs 27 slide over the complimentary edge and become seated in a corresponding slot 29 sized to receive the tab 27. The slots 29 are preferably sized such that the engagement of the tab 27 with the slot 29 places the two components in compression. There is preferably at least one set of tabs and slots on each side of each half of the mount, creating a more stable compressive force that is less likely to allow the mount 20 to twist or pry loose. Each half of the conical mount snaps into alignment with its corresponding mating other half as shown in FIGS. 2*a*–2*d*. The compressive force generated by the engagement of the tabs 27 with the slots 29 provides a frictional resistance that holds the clip 20 and the novelty item 30 at its designated position on the antenna 100.

Figures 3, 4, 5, 6:
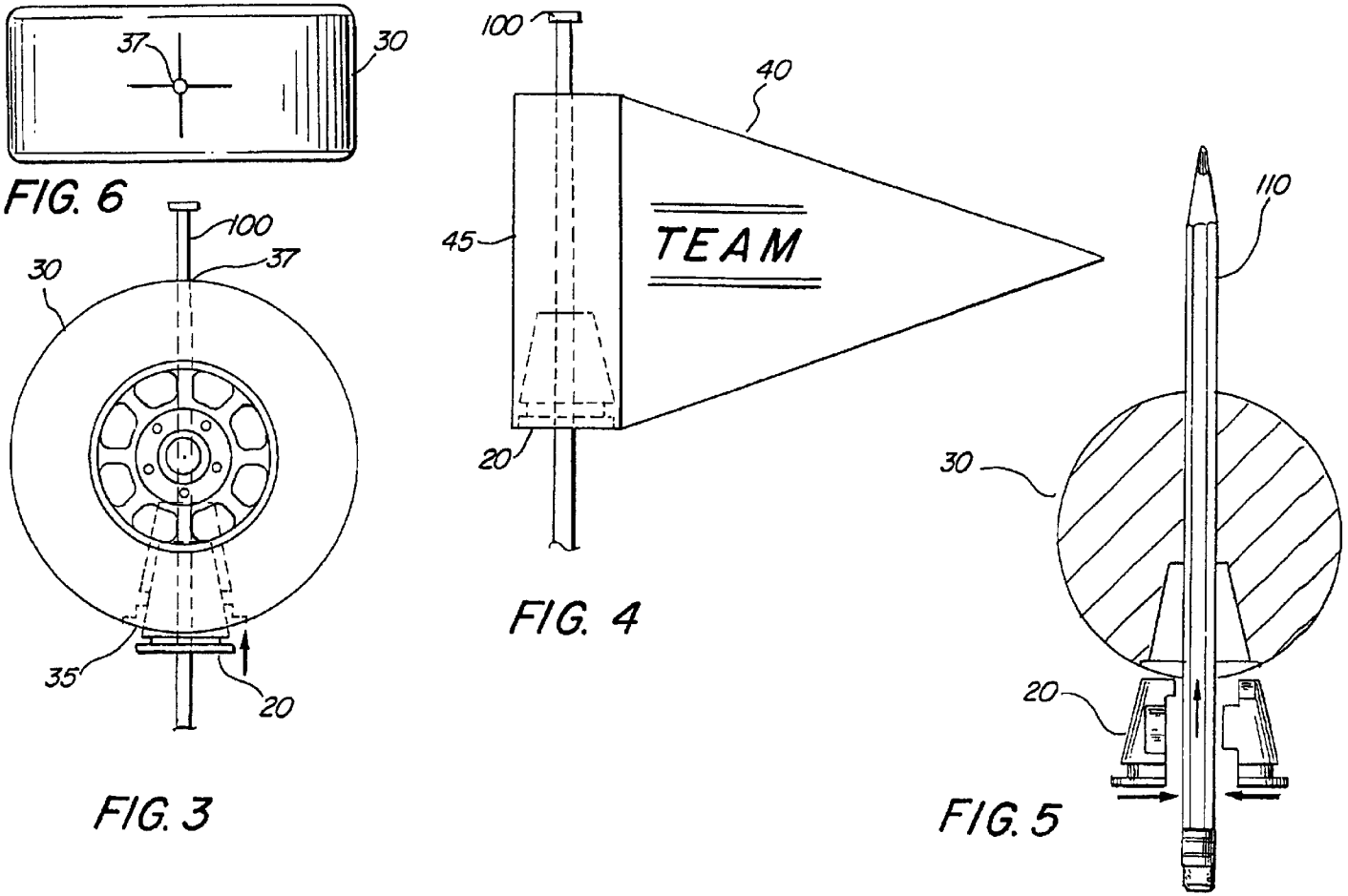
FIG. 3 is a front view of a preferred embodiment of a mounted item on an antenna.
FIG. 4 is a front view of a pennant mounted to an antenna.
FIG. 5 is a front view, partially in sections of a display item mounted to a pencil with an exploded view of the conical mount of the present invention.
FIG. 6 is a top view of the display item shown in FIG. 3.

FIG. 3 illustrates the conical mount 20 supporting a novelty item 30 on an antenna 100. As can be seen in the figure, the novelty item 30 depicted includes a conical aperture 35. The aperture 35 corresponds with the conical outer shape of the mount 20. The relationship is preferably conical, but may be other shapes, rectangular, tubular, triangular, for example. The novelty item 30 rests on and is secured to the-mount 20 after being placed over the antenna 100 and moved downward until mated with the mount 20 by slipping into groove 28 at the base of conical mount 20. To this end, the novelty item will ordinarily have a passage through the item 30 to allow the antenna 100 to pass through an aperture 37 on the top surface of the novelty item 30. A preferred embodiment of the aperture 37 is shown in FIG. 6. As shown, the aperture 37 is preferably a small hole at the center of a cross-shaped perforation in the material of the display item 30. The perforation allows the aperture 37 to expand to fit over the top of an antenna and then contract to the antenna's narrower diameter. With this configuration, the novelty item 30 can be passed down along the length of the antenna 100 to the location of the mount 20, and be set at any desired position on the antenna 100.

It is to be understood that the novelty item can take various forms and still be displayed by the conical mount 20 of the present invention. A few of the many possibilities for adorning an automobile are: a miniature of a football helmet, a soccer ball, basketball, or race car wheel, the head of a cartoon character, or a soft drink can. An exemplary alternative embodiment of a display item is a pennant 40 using the conical mount 20 as shown in FIG. 4. The pennant 40 can be secured to a display item mount 45. The mount 45 is then secured to an antenna 100 using the clip 20 and tapered aperture 35 arrangement as described above.

Alternatively, the mount 20 and tapered aperture 35 arrangement can support a novelty item 30 on a variety of cylindrical posts such as pencil 110 (FIG. 5). The channel 25 (FIG. 2*d* ) of the clip 20 can be varied in sized to accommodate various cylindrical posts.

Thus, a conical mount for novelty items is described that allows a user to mount a novelty item onto, inter alia, an automobile antenna or other cylindrical post such as a pencil anywhere along the length of the post. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A novelty item for mounting to a rod, comprising:

a display item having a top surface and a bottom surface, the bottom surface having an aperture; and a mounting device for mounting to a rod that is an antenna, the mounting device having a first and second end inserted into the aperture of the display item and held therein by a force fit, the mounting device having first and second halves, each half having a portion of a channel, a tab and a slot between the first and second end;

wherein when the first and second halves are joined together, the tabs on the first and second halves fit into and are held by the slots of the first and second halves and the display item aperture fits over and holds the first and second halves together.

2. A novelty item for mounting to a rod, comprising:

a display item having a top surface and a bottom surface, the bottom surface having an aperture; and a mounting device for mounting to a rod that is a writing utensil, the mounting device having a first and second end inserted into the aperture of the display item and held there by a force fit, the mounting device having first and second halves, each half having a portion of a channel, a tab and a slot between the first and second end;

wherein when the first and second halves are joined together, the tabs on the first and second halves fit into and are held by the slots of the first and second halves and the display item aperture fits over and holds the first and second halves together.

3. The novelty item of claim 1 or 2 wherein the display item is a pennant with a post.

4. The novelty item of claim 1 or 2 wherein the display item is a depiction of a racing tire.

5. The novelty item of claim 1 or 2 further comprising a groove at the second end of the mounting device for receiving the bottom surface of the display item.

6. The novelty item of claim 5 or 2 wherein the mounting device is frustaconical, the first end being smaller than the second end.

7. The novelty item of claim 1 or 2 wherein the mounting device is frustaconical, the first end being smaller than the second end.

* * * * *